US008094019B1

(12) United States Patent
Kelsch et al.

(10) Patent No.: US 8,094,019 B1
(45) Date of Patent: Jan. 10, 2012

(54) SELF-SHUNTING SECURITY DEVICE

(75) Inventors: Christopher A. Kelsch, Tarpon Springs, FL (US); John N. Figh, Jr., Valrico, FL (US); Robert S. Meagher, Rochester, VT (US)

(73) Assignee: Vanguard Products Group, Inc., Oldsmar, FL (US)

( * ) Notice: Subject to any disclaimer, the term of this patent is extended or adjusted under 35 U.S.C. 154(b) by 0 days.

(21) Appl. No.: 11/563,724

(22) Filed: Nov. 28, 2006

Related U.S. Application Data

(60) Provisional application No. 60/740,451, filed on Nov. 29, 2005.

(51) Int. Cl.

| | |
|---|---|
| ***G08B 13/12*** | (2006.01) |
| *G08B 13/14* | (2006.01) |
| *G08B 1/00* | (2006.01) |
| *H01R 3/00* | (2006.01) |
| *H01R 24/00* | (2011.01) |

(52) U.S. Cl. ..... 340/568.2; 340/568.4; 340/568.8; 340/531; 439/488; 439/676

(58) Field of Classification Search ..... 340/568.2, 340/568.4, 568.8
See application file for complete search history.

(56) References Cited

U.S. PATENT DOCUMENTS

| | | | | |
|---|---|---|---|---|
| 3,932,857 | A | 1/1976 | Way et al. | |
| 4,455,464 | A | 6/1984 | Leyden | |
| 4,620,182 | A | 10/1986 | Keifer | |
| 4,639,713 | A * | 1/1987 | Kitagawa et al. | 340/427 |
| 4,746,909 | A | 5/1988 | Israel et al. | |
| 4,962,369 | A | 10/1990 | Close | |
| 5,066,942 | A | 11/1991 | Matsuo | |
| 5,124,685 | A | 6/1992 | Rankin | |
| 5,146,205 | A | 9/1992 | Keifer et al. | |
| 5,172,098 | A * | 12/1992 | Leyden et al. | 340/568.2 |
| 5,543,782 | A | 8/1996 | Rothbaum et al. | |
| 5,561,417 | A * | 10/1996 | Rothbaum et al. | 340/568.2 |
| 5,821,857 | A * | 10/1998 | Rand | 340/568.8 |
| 5,995,003 | A * | 11/1999 | Rogers | 340/568.4 |
| 6,104,289 | A | 8/2000 | Rand | |
| 6,278,365 | B1 * | 8/2001 | Kane et al. | 340/531 |
| RE37,590 | E | 3/2002 | Leyden et al. | |
| 6,626,697 | B1 * | 9/2003 | Martin et al. | 439/488 |
| 6,690,277 | B1 | 2/2004 | Hansen et al. | |
| 6,755,055 | B2 | 6/2004 | Sedon et al. | |
| 6,756,900 | B2 | 6/2004 | Leyden et al. | |
| 6,861,953 | B2 | 3/2005 | Deconinck et al. | |
| 7,209,038 | B1 * | 4/2007 | Deconinck et al. | 340/568.8 |
| 2005/0277339 | A1 * | 12/2005 | Caveney et al. | 439/676 |
| 2007/0171061 | A1 * | 7/2007 | Belden et al. | 340/568.2 |

* cited by examiner

*Primary Examiner* — George Bugg
*Assistant Examiner* — Jack Wang
(74) *Attorney, Agent, or Firm* — Patzik, Frank & Samotny Ltd

(57) ABSTRACT

A security device for preventing the theft of merchandise or other articles that provides for a closed loop system that is self-shunting without the need for removable shunt plugs. The preferred device comprises a plurality of jacks attached to a circuit board for receiving connector plug assemblies that are operatively connected to the articles through sensors. When the connector plug assemblies are not within a jack, a jack contact will engage a nail contact to close a circuit, thereby shunting the jack. Insertion of the connector plug assembly will deflect the jack contact away from the nail contact and create a second closed loop indicating that the jack is in use, and which will monitor and warn of any tampering with the sensor on the article.

20 Claims, 3 Drawing Sheets

SELF-SHUNTING SECURITY DEVICE

This application claims priority to U.S. provisional patent application 60/740,451, filed Nov. 29, 2005.

FIELD OF THE INVENTION

This invention relates in general to security systems and anti-theft devices, and more particularly, to self shunting security devices for use in retail stores, offices and other establishments to prevent theft of items such as electronic devices.

BACKGROUND OF THE INVENTION

In order to deter and prevent the theft of various items from retail stores, offices and other establishments, various security devices and systems employing sensors and alarms have been developed. The current systems generally fall into two categories, closed loop systems and open loop systems.

Closed loop systems typically include an alarm box, a splitter box having a number of ports, sensors and a power supply. These systems are referred to as closed loop systems because a circuit loop is formed when the sensors are properly attached to the articles at one end and to the ports of the splitter box by way of a plug at the other end. In particular, the sensor is in an opened state when it is not attached to an article to be protected. Attachment to the article causes a sensor switch to close, thereby creating a closed circuit with the sensors operatively connected to the alarm box. Once the sensors are connected, the system may be "armed." As long as the sensors remain attached to the article and operatively connected to the alarm box, the electrical circuit will remain closed and the security system will remain in the armed state. The removal or, in some cases, attempted removal of the sensor from the article acts to open the switch and break the circuit, thereby sounding an alarm.

One of the problems with conventional closed loop systems is that they require shunt plugs to be inserted into unused ports in the splitter box that are not connected to articles in order to complete the circuit and allow the system to be armed. Use of shunt plugs complicates use of the security system because it requires an extra step and the shunt plugs are easily misplaced. Furthermore, as the system will not arm if the plugs of sensors connected to articles or shunt plugs are not occupying all of the ports, there is a risk that lazy or careless employees or personnel may turn off the security device or system (e.g., if one or more of the shunt plugs are lost or misplaced, whereby the system will not arm with the empty port), thereby allowing for possible theft of the articles.

The circuit in an open loop system is normally closed when the plugs are inserted into the connections and the sensors are attached to an article, and open upon removal of the sensor from the article. In particular, the sensor switch is typically in an open position when unattached to the article. Attaching the sensor to an article acts to close the switch, thereby allowing current to flow in the circuit. Removal of or tampering with the article's sensor acts to open the sensor switch and actuate the alarm. Any ports that do not have a plug properly inserted therein or that do not have sensors that are attached to articles are considered by open loop systems to be open and therefore not protected by the system.

As an open loop system allows the system to arm even if the ports do not contain either a shunt or a sensor that is attached to an article, one problem with these systems is that it is possible for unscrupulous individuals to manipulate or trick the system in such a way as to permit the articles to be stolen.

In particular, an open loop system typically may be circumvented by partially removing the sensor from the article, thereby setting off the alarm if the system is armed. If the personnel monitoring the articles, after turning off the system to quiet the alarm or before turning the system on, does not check to make sure that all of the sensors are properly attached to the articles, when the personnel turns the system back on, the circuit associated with the partially removed plug assembly or improperly attached sensor is therefore open and not protected by the system. Accordingly, the individual can then later come back and remove the article without setting off the alarm. The self-shunting feature of applicant's invention would prevent such 2-step theft.

Therefore, there is a need to produce a security device capable of monitoring a variety of different articles that is retailer-friendly, encourages employees to use the system properly, and addresses the problems with the prior systems and devices, while being economical and easy to manufacture.

SUMMARY OF THE INVENTION

The present invention is an improvement over the prior security systems in the way that the security device provides the benefits of a closed loop system while eliminating the need for removable shunt plugs. In particular, the preferred embodiment of the security system of the present invention comprises a plurality of jacks or ports mounted on a circuit board for receiving connector plug assemblies that are operatively connected to sensors that are attachable to merchandise or other articles.

Each jack includes one or more nail contacts extending upward from or otherwise operatively attached to the circuit board and one or more jack contacts that are normally aligned with the nail contacts so that when the jacks are not in use (i.e., there are no connector plug assemblies inserted), the jack contact will engage the respective nail contact to create a first circuit. Completion of the first circuit acts to shunt the unused port, thereby eliminating the need for an external shunt plug. When a connector plug assembly is inserted into the jack, the end of the connector plug assembly will deflect the jack contact away from engagement with the nail contact, while creating a second circuit with a switch associated with the sensor to monitor and warn of any tampering with the sensor or protected article. When the associated security system is armed, removal of the connector plug assembly from the jack or removal of the sensor from the article will break the second closed circuit and activate an alarm to notify the operator or user of a potential theft or problem with the sensor or protected item or article. Furthermore, in a preferred embodiment, a status indicator such as an LED associated with the port in which the circuit was broken will allow personnel to promptly determine which articles and/or sensors to investigate for any potential thefts or problems.

It is therefore an object of the present invention to provide a new and improved security device for use in the prevention of theft.

Another object of the present invention is to provide a new and improved security device for monitoring articles that is retailer-friendly.

Yet another object of the present invention is to provide a new and improved security device that eliminates removable shunt plugs, but still provides the features and benefits of a closed loop system.

It is yet another object of the present invention to produce a security device that is economical and easy to manufacture and use.

Other objects, features and advantages of the invention will be apparent from the following detailed disclosure, taken in conjunction with the accompanying sheets of drawings, wherein like reference numerals refer to like parts.

DETAILED DESCRIPTION OF THE INVENTION

Figure 2:
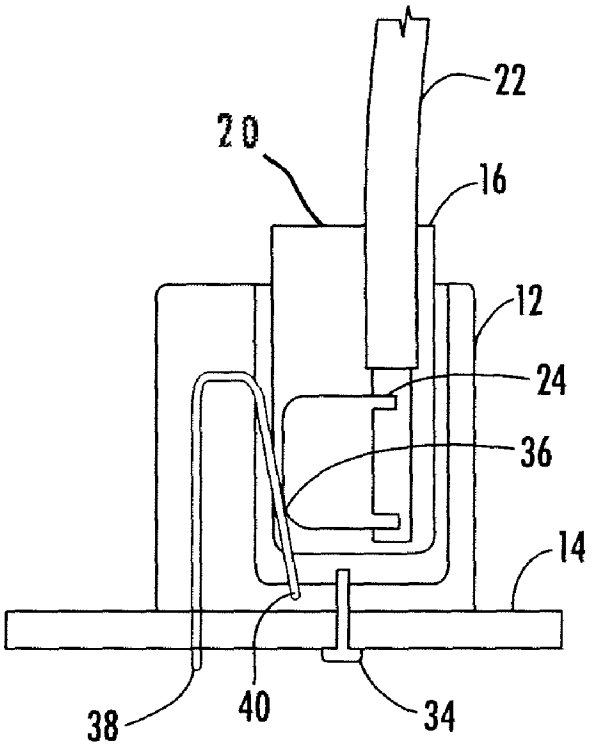
FIG. 2 is a cross sectional view of the security device of FIG. 1 showing the connector plug assembly inserted and engaged with the jack.

While this invention is susceptible of embodiment in many different forms, there is shown in the drawings and will herein be described in detail several specific embodiments, with the understanding that the present disclosure is to be considered merely an exemplification of the principles of the invention and the application is limited only to the appended claims.

Figure 1:
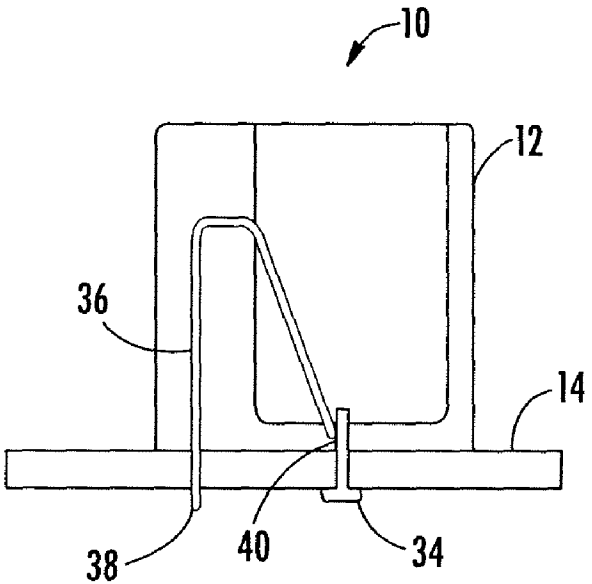
FIG. 1 is cross sectional view of the security device of the present invention showing the device prior to insertion of a connector plug'assembly.
Figure 3:
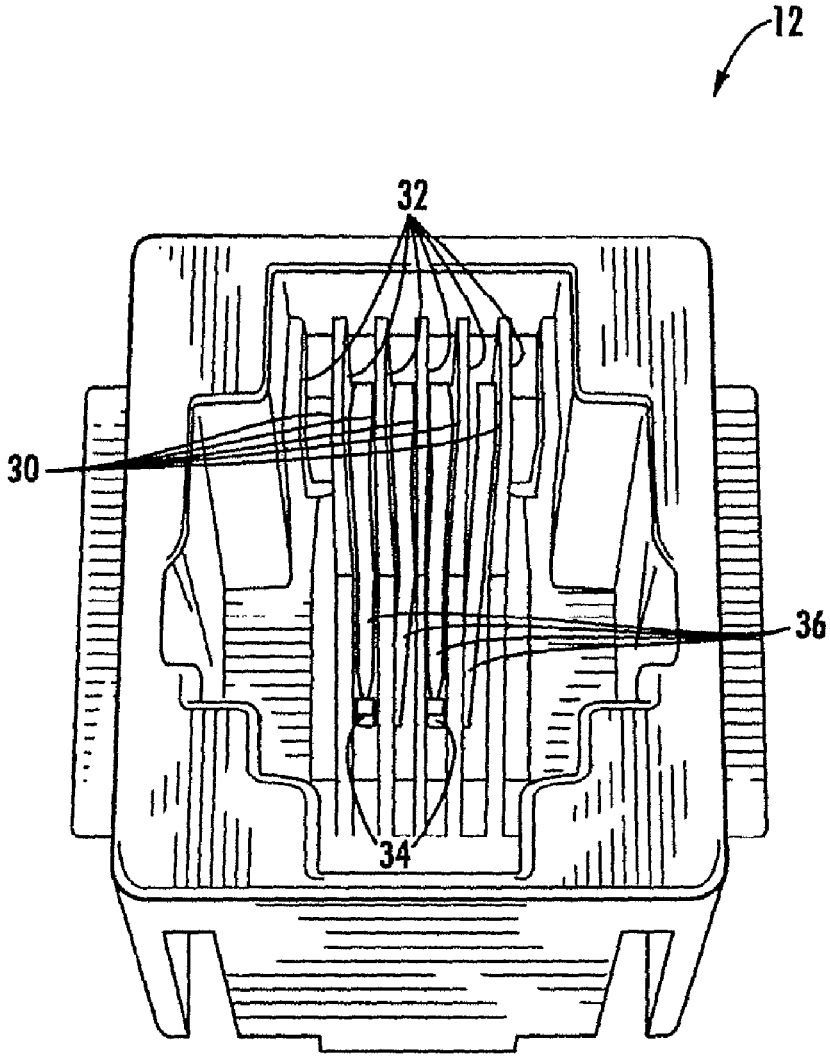
FIG. 3 is a top plan vie 7 of the jack of the security device of FIG. 1 showing the jack contact engaged with the nail contact to complete the first circuit.

Referring now to the drawings and particularly to FIGS. 1 through 3 there is shown a preferred embodiment of the present invention. The security device of the present invention, generally designated by the number 10, is shown as having a connector jack 12 mounted on a circuit board 14 for insertion of a connector plug assembly 16. In the preferred embodiment, the security device has a plurality of connector jacks for the insertion of connector plug assemblies that are attached to a plurality of articles or merchandise or the like sought to be protected from theft. While only one jack and connector plug assembly is described, herein, it should be understood that each of the jacks and connector plug assemblies are of a similar configuration and that any number of jacks and plug assemblies should be considered as part of the written scope of the present invention. It is noted that the system is operational even if connector plug assemblies are not inserted into each of the connector jacks.

Figure 4:
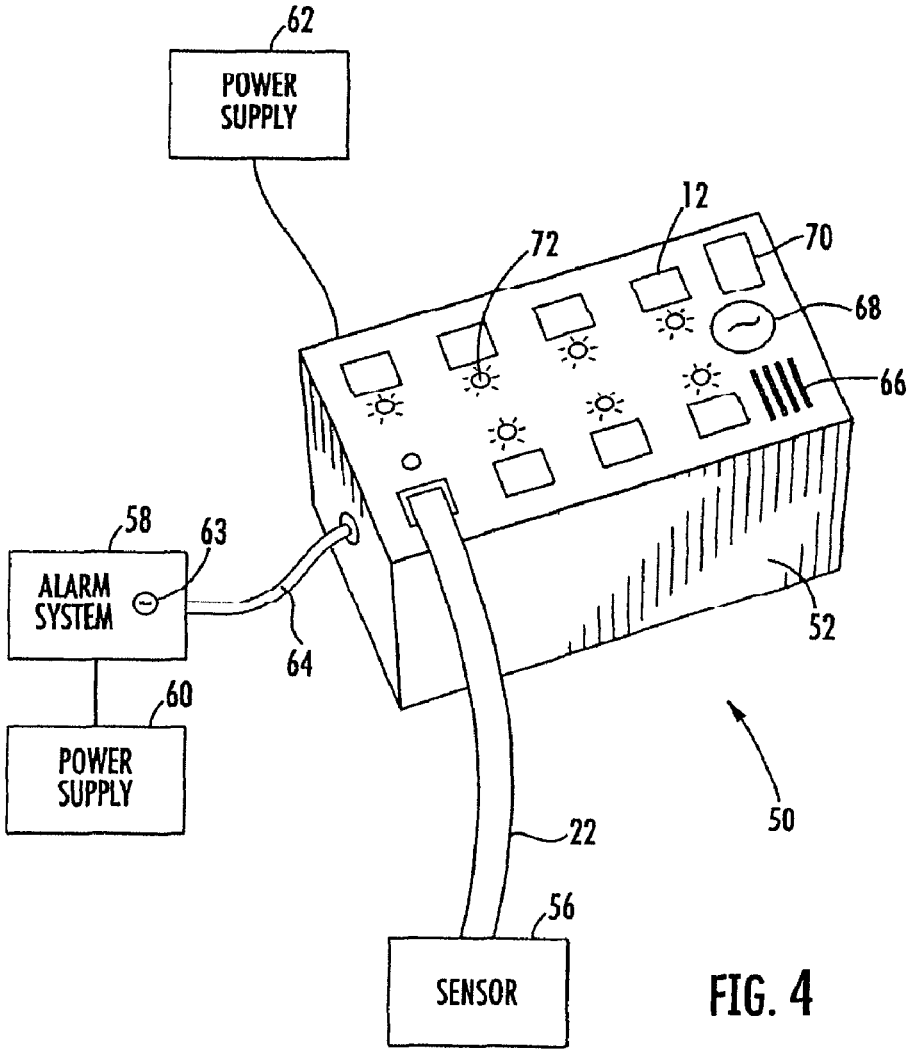
FIG. 4 is a schematic view of the security device of the present invention as used in one embodiment of a security system.

Referring now to FIG. 4, there is shown a security or alarm system for use with the security device of the present invention. The security system, generally designated by the numeral 50 comprises a splitter box or jack box 52 having a plurality of jacks 12 mounted therein for receiving one or more connector plug assemblies 16, an alarm system 58, and a power supply 62.

The alarm system 58 includes a housing enclosing an alarm circuit and an audible alarm such as, but not limited to, a horn or siren. A switch controlled by a keyhole 63 allows for the alarm system 58 to be selectively armed and disarmed. Power is preferably supplied to the alarm system 58 through an external power supply 60 such as, but not limited to, an AC adapter and an electrical wall socket, or an external battery. It is also appreciated that the alarm system 58 may include an internal battery or other type of power supply and not depart from the scope of the present invention. The alarm system 58 is preferably connected to splitter box 52 through an electrical cord or cable 64 such as, but not limited to, a telephone cord or coaxial cable.

It is also appreciated that the security device may be utilized with a system wherein the alarm or alarm system 66 is incorporated into or integral with the splitter box 52. In such a case, the splitter box may be fitted with a keyhole 68 for accepting a key for selectively arming and disarming the alarm system 66. The splitter box 52 may either be powered by an external power supply 62 such as, but not limited to, an AC adapter and an electrical outlet or an external battery, or it may contain an internal battery 70.

Referring now to FIGS. 1 and 3, the security device 10 of the present invention is shown without a connector plug assembly 16 inserted therewithin. The jack 12 includes a series of walls 30 that define a plurality of slots 32 for receiving corresponding pins of the connector plug assembly 16, one or more nail contacts 34 extending upward from or otherwise operatively attached or connected to the circuit board 14, and an equal number of jack contacts 36 aligned with the nail contacts 34. Each jack contact 36 preferably has a fixed end 38 that is attached to or mounted on the circuit board 14 and a free end 40 that may move relative to the fixed end 38. In one embodiment shown in FIGS. 1 and 2, the jack contact may comprise a substantially inverted U-shaped contact. As shown in FIG. 1, the free end 40 of the jack contact 36 is normally biased against or in contact with the nail contact 34 when the jack 12 is not in use (i.e., a connector plug assembly 16 is not inserted therewithin). In a preferred embodiment, engagement of the nail contact 34 by the jack contact 36 serves to complete a circuit and shunt the jack. Additionally, a status indicator 72 on or associated with the splitter box 52 may remain of to indicate that there are no connector plug assemblies 16 positioned within the respective jack 12. The status indicator may be, but is not limited to a light or an LED.

The jack contact 36 is made of a resilient or spring-like material to permit the jack contact 36 to return to its initial state and engage the nail contact 34 upon removal of the connector plug assembly 16 from the jack 12. As shown in FIG. 1, the removal of the connector plug assembly 16 from the jack 12 allows the free end or leg member 40 of the jack contact 36 to return or revert to its non-deflected state and into contact with the nail, contact 34 to complete the circuit. Completion or closing of the circuit with respect to the open jack or jacks thus allows the security system to arm without the necessity of using shunt plugs. During the removal of the connector plug assembly from the jack, there will be a moment of time where the circuits will be open, thereby causing the alarm to activate until the alarm system is turned off.

When no connector plug assembly is fully inserted into the respective jack, the indicator light will not illuminate, thereby indicating which jacks are not in use. Accordingly, the system of the present invention will notify the user (e.g., retail store personnel) of any connector plug assemblies that are partially inserted into or removed from the jacks to prevent sensors or connector plug assemblies from being partially removed to enable the product to be later stolen.

Referring again to FIG. 2, the connector plug assembly 16 comprises a housing 20 at the end of a cable 22 (e.g., a coaxial cable) having a plurality of conductive portions. The conductive portions are electrically attached to conductive portions or conductors on the male end 24 of the connector plug assembly 16 in a known way. When the connector plug assembly is inserted into a jack on the splitter box, the conductive portions of the connector plug assembly engage the jack contact or contacts to complete a second circuit with a switch associated with the sensor to monitor and warn of any tampering with the sensor on the article. In one embodiment, the cable comprises a plurality of wires for among other things, carrying electrical current or power; a sensor signal to indicate that the sensor 56 is or is not properly attached to an article being monitored; and, optionally, a signal for a status indicator such as, but not limited to, a light or LED.

In one embodiment, when the system is armed and the second circuit is complete (i.e., a jack is properly inserted in a respective port and the sensor is properly attached to an article), the system will illuminate the indicator light or other status indicator 72 associated with the respective port to indicate that the article is properly protected. When the second circuit is broken in connection with one of the ports (e.g., a sensor is removed from an article), in addition to triggering the alarm, the respective indicator light may flash to indicate which sensor and article have problems or have been potentially compromised.

It is appreciated that the sensor may be any of the known types of sensors for use with security systems for monitoring articles such as, but not limited to clips, RJ-type plugs, adhesive strips and housing members, or the like. Examples of sensors are shown in U.S. Pat. Nos. 5,172,098 and 6,956,479, the teaching of which is hereby incorporated by reference. For example, the sensor may include an adhesive sheet having a hole that is placed on and adhered to an article, and a sensor housing having a button that extends into the hole and is biased inward when attached to a product, thereby biasing a first conductor into engagement with a second conductor. The removal or, in some cases, attempted removal of the sensor housing from the product causes the first conductor to disengage from the second conductor, thereby breaking the circuit and activating an alarm or other warning. As another example, the sensor may comprise a housing having a passage that permits an elongated fastener to extend through the housing and attach the sensor to a surface. When attached to the surface, the elongated fastener engages a pair of contacts within the housing to form an electrical path (i.e., close the circuit). Removing or withdrawing the elongated fastener from engagement with the surface acts to break the circuit and activate an alarm or other warning.

It will be understood that modifications and variations may be effected without departing from the scope of the novel concepts of the present invention, but it is understood that this application is limited only by the scope of the appended claims.

The invention claimed is:

1. A system including a splitter box having a plurality of jacks having cavities for receiving connector plugs operatively connected to sensors for attaching to products and having conductors for sending signals to a warning indicator when the sensors are tampered with for preventing theft of one or more products operably connected to the system by generating a signal to indicate that unauthorized removal from the system is being attempted, the system comprising:

circuitry;

a sensor having a first end and a second end, wherein the first end of the sensor is operably attached to one of the one or more products;

the jacks being operably attached to the circuitry, wherein the sensor is operably connectable to one of the jacks at the second end;

a plurality of jack contacts operably connected to the circuitry and extending into each of the cavities of the jacks; and a plurality of nail contacts operably connected to the circuitry, each nail contact having a resilient leg member that extends into one of the cavities of the jacks and is normally biased to operatively contact the jack contact to automatically form a first closed circuit when the second end of the sensor is not inserted in the cavity of the jack without the need for a shunt plug;

wherein insertion of the second end of the sensor into the cavity of the jack allows the end of the sensor to operatively move the nail contact from a first position contacting the jack contact to a deflected position to automatically form a second closed circuit with the warning indicator so that tampering with the sensor or removing the second end of the sensor from the cavity of the jack automatically open the second closed circuit to activate the warning indicator.

2. The system of claim 1 which further comprises a plurality of sensors, jacks, status indicators, first contacts and second contacts for protecting a plurality of products.

3. The system of claim 1 which further comprises a status indicator, wherein completion of the second closed circuit activates the status indicator.

4. The system of claim 3 wherein the status indicator is a light.

5. The system of claim 3 wherein the status indicator is a LED.

6. The system of claim 1 wherein the warning indicator is an audible alarm.

7. The system of claim 1 wherein the warning indicator is a visual alarm.

8. A security device for receiving one or more connector plugs comprised of a conductive cable that is operatively attached to one or more articles through sensors to send signals to a warning indicator when the sensors are tampered with to prevent the theft of the articles, the security device comprising:

a circuit board;

at least one jack connected or attached to the circuit board, wherein the jack has a cavity for receiving one of the connector plugs;

a jack contact operatively connected to the circuit board and extending into the cavity of the jack; and a nail contact operatively connected to the circuit board and having a resilient leg member that abuts against the jack contact to automatically form a first closed circuit without the need for a shunt plug when none of the connector plugs are inserted in the cavity;

wherein insertion of one of the connector plugs into the cavity of the jack allows the connector plug to engage the resilient leg member of the nail contact and deflect it away from the jack contact, and wherein engagement of the connector plug by the leg member automatically forms a second closed circuit with the warning indicator so that tampering with the sensor or removing the connector plug from the cavity of the jack will automatically break the second closed circuit and activate the warning indicator.

9. The security device of claim 8, which further comprises a status indicator for notifying when the jack has a connector plug inserted in its cavity.

10. The security device of claim 9, wherein completion of the second circuit will activate the status indicator.

11. The security device of claim 10, wherein the status indicator is a light.

12. The security device of claim 10, wherein the status indicator is an LED.

13. In a security system having a splitter box having a plurality of jacks having cavities for receiving connector plugs, the connector plugs being operatively connected to sensors for attaching to articles and having conductors for sending signals to an alarm when the system is activated and the sensors are tampered with, the improvement comprising:

at least one jack contact extending upward into each of the cavities of the jacks; and at least one nail contact having a resilient leg member extending into each of the cavities of the jacks, the second contact having a first position wherein it engages the at least one first contact to automatically create a first closed circuit when the connector plug is not inserted within the cavity of the jack, and a second or deflected position wherein insertion of one of the connector plugs deflects the nail contact away from the jack contact to automatically create a second closed circuit with the alarm without the need for a shunt plug;

wherein tampering with the sensor or removing the connector plug from the jack will activate the alarm.

14. The security system of claim 13, which further comprises a status indicator for notifying when one of the jacks has a connector plug inserted in its cavity.

15. The security system of claim 14, wherein completion of the second circuit will activate the status indicator.

16. The security system of claim 14, wherein the status indicator is a light.

17. The security system of claim 14, wherein the status indicator is an LED.

18. A method for protecting thefts of one or more articles operably connected to a system comprising an alarm box, with or without an integral splitter box, having a plurality of jacks for receiving connector plugs, the connector plugs being operatively connected to sensors for attaching to the one or more articles, the method comprises the steps of:

providing jacks for receiving the connector plugs to create a circuit and protect the articles operatively attached to the connector plugs;

providing an alarm for signaling when any of the sensors operatively attached to the connector plugs inserted into the jacks are tampered with or any of the connector plugs are removed from their respective jacks;

providing a jack contact extending into each of the cavities of the jacks; and providing a nail contact operably connected to said jack contact and having a resilient leg member that extends into the cavities of the jacks and operatively contacts the jack contact to automatically form a first closed circuit so as to self-shunt the jacks in which no connector plugs are properly inserted therein without the need for a shunt plug and automatically form a second closed circuit with an alarm.

19. The security system of claim 13 wherein the second contact is substantially U-shaped.

20. A system for preventing theft of one or more products operably connected to the system by generating a signal to indicate that unauthorized removal from the system is being attempted, the system comprising: circuitry; a sensor having a first end and a second end, wherein the first end of the sensor is operably attached to one of the one or more products; a port being operably attached to the circuitry, wherein the sensor is operably connectable to the port at the second end; a jack contact operably connected to the circuitry and extending into the port; and a resilient nail contact operably connected to the circuitry and having a portion that operatively contacts the jack contact to automatically form a first closed circuit when the second end of the sensor is not connected in the port without the need for a shunt plug; wherein insertion of the second end of the sensor into the port allows the sensor to operatively move the second nail contact from contacting the jack contact and automatically form a second closed circuit so that tampering with the sensor or removing the second end of the sensor from the port automatically opens the second closed circuit to activate the warning indicator; and, a status indicator for notifying when the second end of the sensor is properly inserted within the port to form the second closed circuit.

* * * * *